US010131161B1

(12) United States Patent
Warzel

(10) Patent No.: US 10,131,161 B1
(45) Date of Patent: Nov. 20, 2018

(54) METHOD OF TRANSFER PRINTING ON ARTICLES

(71) Applicant: Starline USA, Inc., Grand Island, NY (US)

(72) Inventor: Eric Warzel, Cheektowaga, NY (US)

(73) Assignee: Starline Global, Inc., Bridgetown (BB)

( * ) Notice: Subject to any disclaimer, the term of this patent is extended or adjusted under 35 U.S.C. 154(b) by 0 days.

(21) Appl. No.: 14/984,909

(22) Filed: Dec. 30, 2015

(51) Int. Cl.
*B41J 11/00* (2006.01)

(52) U.S. Cl.
CPC ..... *B41J 11/0015* (2013.01)

(58) Field of Classification Search
CPC ..... B41J 11/0015; B41J 11/002; B41J 2/005; B41J 2/0057; B41J 2002/012; B41J 2/22; B41J 2/315
See application file for complete search history.

(56) References Cited

U.S. PATENT DOCUMENTS

2003/0001942 A1* 1/2003 Odamura ..... B41J 11/002 347/213
2004/0032477 A1* 2/2004 Baker, Jr. ..... B41J 11/0015 347/102
2004/0142765 A1* 7/2004 Kennedy, III ..... A63B 45/02 473/351
2004/0218028 A1* 11/2004 Furukawa ..... B41J 2/0057 347/101
2015/0165739 A1* 6/2015 Taniuchi ..... C09D 11/322 156/62.2

* cited by examiner

*Primary Examiner* — Bradley Thies
(74) *Attorney, Agent, or Firm* — Hodgson Russ LLP

(57) ABSTRACT

A method for printing on an article is disclosed wherein a transfer medium is loaded into a digital printer. A print head of the printer is used to deposit a main color layer on the transfer medium. A primer layer is deposited onto the main color layer. In some embodiments, an initial color layer is deposited prior to deposition of the main color layer. An adhesive powder is deposited on the primer layer, and the main color layer and primer layer are cured using ultraviolet illumination. The transfer medium is contacted (placed into contact) with the article and heat and/or pressure are applied to transfer the deposited layers to the article. The transfer medium is removed leaving the main color layer and primer layer adhered to the article.

12 Claims, 2 Drawing Sheets

METHOD OF TRANSFER PRINTING ON ARTICLES

FIELD OF THE DISCLOSURE

The disclosure relates to a method of printing on articles, such as fabric articles, using a digital printer.

BACKGROUND OF THE DISCLOSURE

Printing images or text onto flexible articles has long been performed using screen printing techniques. While screen printing is often accomplished by direct application onto the article, it is also done by way of transfer printing, where the reverse of the desired image is screen printed onto a transfer medium, and then transferred onto the article. In screen printing, a mesh is used to transfer ink onto a substrate (e.g., the article or the transfer medium). A blocking stencil is used as a mask to block the screen-printing ink from being applied in some areas, thereby forming the final shape of the print. Multiple screens are used where multiple colors are applied to make up the final image. Each of the screens must be created before the printed articles can be produced. However, screen printing can be cost prohibitive for low-volume applications, where the cost for set up time and materials must be recouped over few finished products.

Digital printing is gaining acceptance as an alternative to screen printing, especially for low-volume applications. In digital printing, a printer (often an ink-jet printer) is used to deposit one or more inks onto an article to create the finished product. Because the setup is accomplished digitally, there is no need for customer tooling (e.g., screens) to be created before printing. As such, the cost for a low-volume run is significantly lower than the cost for a comparable screen print. However, printing to flexible or otherwise unwieldy articles is difficult or impossible when using such direct printing.

BRIEF SUMMARY OF THE DISCLOSURE

A method for printing on an article is disclosed wherein a transfer medium is loaded into a digital printer. A print head of the printer is used to deposit a main color layer on the transfer medium. The main color layer may be a four-color layer, for example, a CMYK layer. A primer layer is deposited onto the main color layer. In some embodiments, an initial color layer is deposited prior to deposition of the main color layer. Such an initial color layer may have a thickness which is less than a thickness of the main color layer. An adhesive powder is deposited on the primer layer, and the main color layer and primer layer are cured using ultraviolet illumination. The transfer medium is contacted (placed into contact) with the article and heat and/or pressure are applied to transfer the deposited layers to the article. The transfer medium is removed leaving the main color layer and primer layer adhered to the article.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Figure 1:
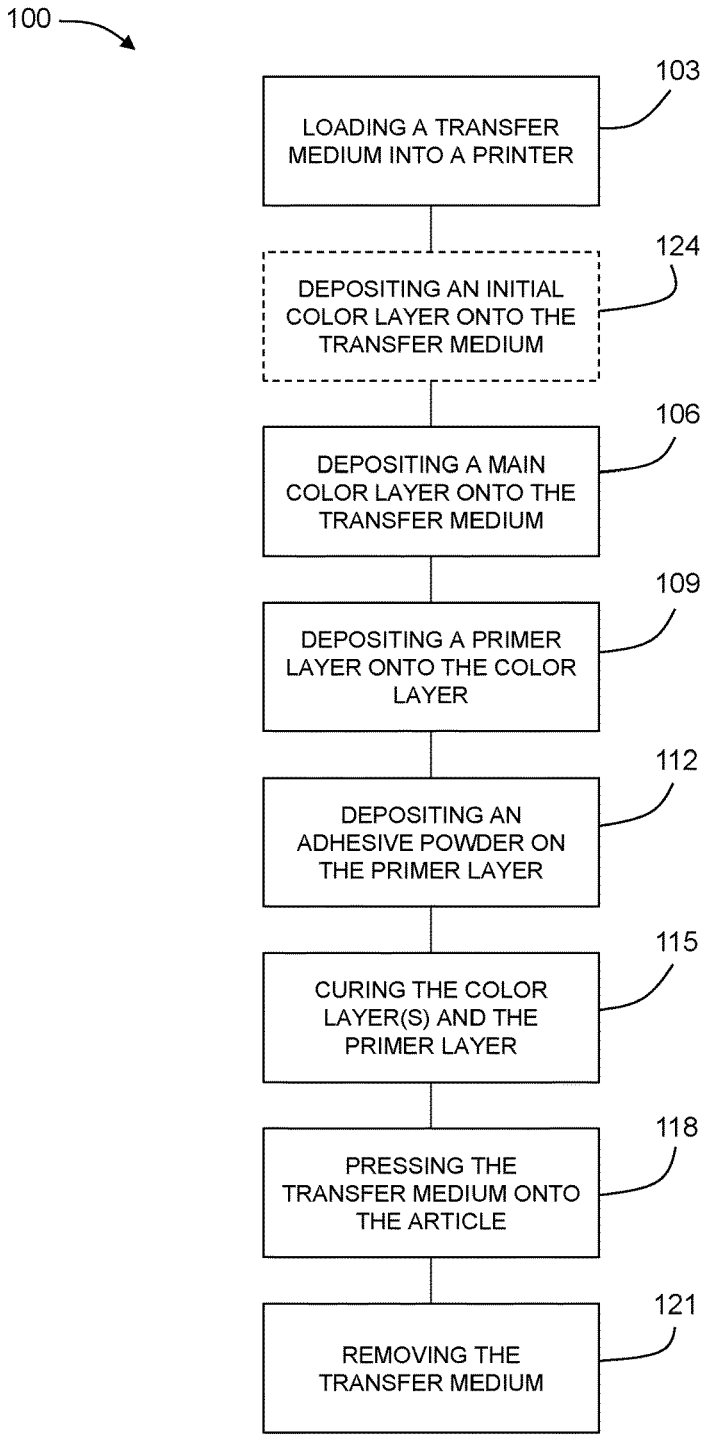
FIG. 1 depicts a method according to an embodiment of the present disclosure.
Figure 2:
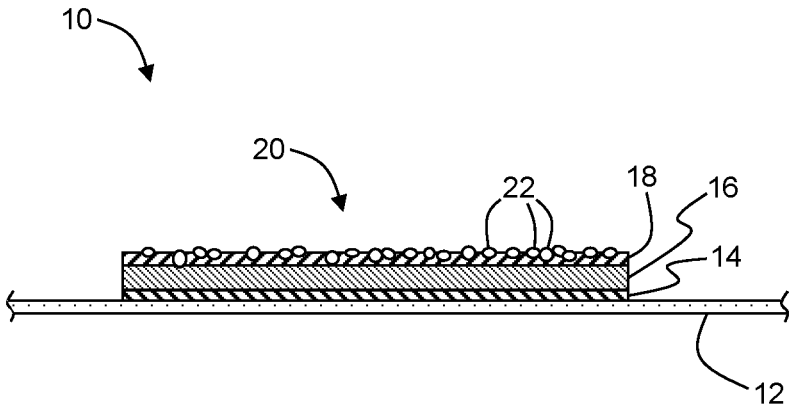
FIG. 2 is a diagram depicting an embodiment of an elevation of a transfer assembly having an initial color layer.

With reference to FIGS. 1 and 2, the present disclosure may be embodied as a method 100 for printing on an article. In particular, the method 100 is used for transfer printing onto an article. The method 100 is suitable for transfer printing onto bulky articles such as, for example, duffle bags, backpacks, and the like, but is should be noted that the method 100 can be used for any articles.

In the method 100, a transfer medium 12 is loaded 103 into a printer. Transfer mediums, such as transfer papers, are known for use in screen printing. It has been found that parchment paper is well-suited for use as a transfer medium with the current method 100. Such parchment paper may be coated with a coating such as, for example, Quilon®, silicone, etc.

A layer of colored ink is deposited 106 onto the transfer medium—the "main color layer" 16—using a print head of the printer. The ink is a light curable ink, such as, for example, an ink that is cured by ultraviolet light. In this way, the ink remains wet (i.e., has a low viscosity) until cured using, for example, an ultraviolet light. In an embodiment, the ink is a flexible ink. The main color layer may be deposited 106 as a 4-color process, for example, the main color layer may comprise a cyan, magenta, yellow, and black ink (a so-called "CMYK" process). The main color layer is deposited 106 in the reverse of the final desired shape and color of the transfer. For example, where a logo is to be transfer printed onto an article, the main color layer is deposited 106 as a reverse of the logo. It should be noted that current printers may deposit layers of ink in multiple passes of the print head. As such, the main color layer may be deposited 106 onto the transfer medium using multiple passes of the print head, for example, more than 10 passes of the print head. In a particular embodiment, the main color layer is deposited 106 in 12 passes of the print head. However, in various embodiments, the main color layer may be deposited in any number of passes.

A layer of primer ink is deposited 109 onto the main color layer. In some embodiments, the primer layer 18 will have the geometry of the main color layer and is not deposited directly onto the transfer medium in a significant way (i.e., the primer layer is deposited 109 onto the main color layer within the precision of the printer). In other embodiments, such as when using a clear primer as described below, the primer layer may extend beyond the extents of the main color layer. The primer ink may be light curable using the same or different light as the main color layer. The primer layer is deposited 109 using a print head of the printer. The ink of the primer layer may be a flexible ink. The ink may be any color—it is common that such primer inks are white or clear, though other colors may be used. White primer has been found to advantageously contribute to the vibrancy of the final print. Clear primer has been found to be advantageous in some embodiments because clear primer may be used to bleed the edges of the print—i.e., the primer layer may extend beyond the extents of the main color layer. The primer layer may be deposited 109 in any number of passes of the print head—for example, fewer passes than the main color layer, the same number of passes as the main color layer, or more passes than the main color layer. In a particular embodiment, the primer layer is deposited 109 in 6 passes of the print head.

An adhesive powder 20 is deposited 112 on the deposited ink layers while the ink layers are uncured. In this way, adhesive "grains" 22 making up the adhesive powder can embed themselves into the ink layers by force of gravity. Adhesive powders are used to join materials together through the application of pressure and/or heat. It has been found to be advantageous to select the adhesive powder such that the grains of the adhesive powder are large enough to partially embed themselves into at least the primer layer, but not so large (i.e., heavy) that they become completely submerged in the ink layers (see, for example, FIG. 2). In this manner, the deposited 112 adhesive powder can best adhere the transfer assembly 10 to the article. It will therefore be apparent to one skilled in the art that the adhesive powder may be selected, in part, according to the viscosity of the uncured ink. Adhesive powders are available with particle sizes ranging from coarse (e.g., 100 to 300 microns), to medium (e.g., 60 to 200 microns), to fine (e.g., 1 to 80 microns), though these are exemplary categories and are not intended to be limiting. In a particular embodiment using flexible inks, a fine grain adhesive powder (grain size less than 100 microns) was found to provide good performance. Size is generally measured as the largest diameter of a particle.

The adhesive powder can be deposited 112 in any manner. For example, in a manual application, the adhesive powder is deposited 112 by an operator sprinkling the powder onto the ink layers in a "gross" manner—i.e., sprinkling the powder generally on to the ink layers where the powder may also be deposited onto the transfer medium. In this example, excess powder can be removed by, for example, tilting the transfer medium thereby allowing the excess to fall off. In another embodiment, the adhesive powder is deposited 112 in a more precise manner using an adhesive head which deposits the adhesive onto the ink layers without a significant deposit onto the transfer medium.

The main color layer and the primer layer are then cured 115 using light. For example, the ink layers are cured by exposing the layers to ultraviolet ("UV") light. In a particular example, the transfer assembly (i.e., the transfer medium with deposited ink layers and adhesive powder) is conveyed beneath a UV light. The UV light may be provided by, for example, a mercury halide lamp, one or more light-emitting diodes, or other suitable sources. While many current printers are configured with print heads that include UV light sources so that the ink may be cured immediately upon deposition, in the present disclosure, such printers were modified to disable the UV light of the print head. In this way, the deposited ink layers remained uncured until after the adhesive powder was deposited 112 and allowed to be partially embedded into the ink layers.

The transfer assembly is then placed into contact 118 with the article such that the ink layers and adhesive powder is in contact with the article and the transfer medium is opposite the article with respect to the ink layers. Heat and/or pressure is applied so as to cause the adhesive powder and primer layer to adhere to the article. The transfer medium is then removed 121 by peeling from the ink layers and article. In this way, the ink layers remain joined to the article by way of the adhesive powder.

In an embodiment, an initial color layer 14 is deposited 124 onto the transfer medium using a print head of the printer. The initial color layer is deposited 124 before deposition 106 of the main color layer described above. This initial color layer has been found to improve the quality of the finished product (the ink layers adhered to the article) whereby the colors are more saturated and/or vibrant. In such an embodiment, the main color layer is deposited 106 onto the transfer medium indirectly—by deposition 106 onto the initial color layer. The initial color layer is the same pattern as the main color layer. For example, where a logo is printed, the initial color layer and the main color layer are both of the same logo image. The initial color layer may be thinner than the main color layer. For example, the initial color layer may be deposited 124 by fewer than 10 passes of the print head, where the main color layer may be deposited 106 by more than 10 passes. In a particular example, the initial color layer is deposited 124 onto the transfer medium by 6 passes of the print head.

In some embodiments without an initial color layer, a similar effect (improved quality of finished product) may be achieved by application of a higher concentration (heavier application) of ink. Higher concentration of ink can be applied by altering the settings of the printer, for example, in some printers an increased resolution will result in a higher concentration of ink.

In some embodiments of the present disclosure, transfers for more than one article may be printed onto the transfer medium. For example, where an image is to be transferred to an article, more than one copies of the image (or different images) can be printed (using the method described above) onto the transfer medium. In such embodiments, the transfer medium is cut 127 to separate the printed images before being adhered to the corresponding articles.

The present disclosure may be embodied as a transfer assembly 10 comprising a transfer medium 12. The transfer medium 12 may be, for example, parchment paper, including coated parchment paper. The transfer assembly 10 further comprises a main color layer 16 disposed on the transfer medium 12. The main color layer 16 may be disposed on the transfer medium 12 directly (wherein the main color layer 16 is in contact with the transfer medium 12) or indirectly (wherein one or more elements are located between the main color layer 16 and the transfer medium 12). For example, an initial color layer 14 may be disposed on the transfer medium 12 and the main color layer 16 is on the initial color layer 14—i.e., directly disposed on the initial color layer 14 and indirectly disposed on the transfer medium 12 (by way of the initial color layer 14). The transfer assembly 10 has a primer layer 18 disposed on the main color layer 16. The transfer assembly 10 includes adhesive powder 20. For example, a plurality of grains 22 of an adhesive powder 20 may be disposed on the primer layer 18. As such, one or more grains 22 of the plurality of grains 22 may be disposed on the primer layer 18 such that the one or more grains 22 are partially embedded in the primer layer 18.

Although the present disclosure has been described with respect to one or more particular embodiments, it will be understood that other embodiments of the present disclosure may be made without departing from the spirit and scope of the present disclosure.

What is claimed is:

1. A method for printing on an article, comprising:

loading a transfer medium into a printer;

depositing, using a print head of the printer, a main color layer on the transfer medium;

depositing, using a print head of the printer, a primer layer on the main color layer;

while the deposited layers are uncured, depositing an adhesive powder on the primer layer;

curing the main color layer and the primer layer, using ultraviolet illumination;

contacting the transfer medium with the article and applying heat and/or pressure to transfer the deposited layers to the article; and removing the transfer medium;

wherein the adhesive powder comprises particles having a particle size selected based upon a viscosity of the primer layer such that the adhesive powder is partially embedded into the primer layer;

wherein curing the primer layer fixes the adhesive powder partially outside of the primer layer.

2. The method of claim 1, further comprising depositing an initial color layer on the transfer medium prior to deposition of the main color layer.

3. The method of claim 2, wherein the initial color layer has a thickness which is less than a thickness of the main color layer.

4. The method of claim 2, wherein the initial color layer is deposited in less than 10 passes of the print head.

5. The method of claim 4, wherein the main color layer is deposited in more than 10 passes of the print head.

6. The method of claim 1, wherein the main color layer is deposited as four colors.

7. The method of claim 1, further comprising removing the transfer medium from the printer before the adhesive powder is deposited.

8. The method of claim 1, wherein the particles of the adhesive powder are less than 100 microns in size.

9. The method of claim 1, wherein the main color layer comprises a flexible ink.

10. The method of claim 1, wherein the transfer medium is parchment paper.

11. The method of claim 10, wherein the parchment paper is coated with Quilon or silicone.

12. The method of claim 1, wherein the primer layer is deposited on the main color layer so as to bleed the edges such that the primer layer extends beyond edges of the main color layer.

* * * * *